US009320411B2

(12) United States Patent
Lundberg et al.

(10) Patent No.: US 9,320,411 B2
(45) Date of Patent: Apr. 26, 2016

(54) TABLE TOP DISHWASHER

(75) Inventors: Mats Lundberg, Vallingby (SE); Luigi Salerno, Cinisello Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 241 days.

(21) Appl. No.: 13/814,381

(22) PCT Filed: Jul. 13, 2011

(86) PCT No.: PCT/EP2011/003486

§ 371 (c)(1),
(2), (4) Date: Apr. 9, 2014

(87) PCT Pub. No.: WO2012/016631

PCT Pub. Date: Feb. 9, 2012

(65) Prior Publication Data

US 2014/0285075 A1 Sep. 25, 2014

(30) Foreign Application Priority Data

Aug. 6, 2010 (EP) ..... 10008216

(51) Int. Cl.
*A47L 15/00* (2006.01)
*A47L 15/42* (2006.01)

(52) U.S. Cl.
CPC ..... *A47L 15/0089* (2013.01); *A47L 15/4251* (2013.01); *A47L 15/4257* (2013.01); *A47L 15/4261* (2013.01)

(58) Field of Classification Search
None
See application file for complete search history.

(56) References Cited

U.S. PATENT DOCUMENTS

| | | | | |
|---|---|---|---|---|
| 1,853,529 A | | 4/1932 | Zademach | |
| 1,859,302 A | | 5/1932 | Lederman | |
| 2,063,746 A | | 12/1936 | Meeker | |
| 2,517,420 A | * | 8/1950 | Gauvreau | A47F 3/001 220/252 |
| 2,850,025 A | | 9/1958 | Bond | |
| 3,460,878 A | * | 8/1969 | Appel et al. | 312/297 |

(Continued)

FOREIGN PATENT DOCUMENTS

| | | |
|---|---|---|
| DE | 4438279 A1 | 5/1996 |
| DE | 102004057019 | 6/2006 |

(Continued)

OTHER PUBLICATIONS

International Search Report for Application No. PCT/EP2011/003486 dated Jul. 13, 2011.

(Continued)

*Primary Examiner* — Michael Barr
*Assistant Examiner* — Cristi Tate-Sims
(74) *Attorney, Agent, or Firm* — Alston & Bird LLP

(57) ABSTRACT

A table top dishwasher comprises: (a) a tub (10) for accommodating articles to be cleaned; and (b) a cover member (12) forming a water-tight hood over said tub (10), said hood comprising a fixed hood portion (14) and a door (16), the door comprising a central region (30) and two lateral side portions (32) rotatably connected to the fixed hood portion, the door (16) being rotatable between a closed position in which the central region forms part of the hood, and an opened position in which the door is positioned within the fixed hood portion, wherein said side portions (32) each comprise at least one aperture (38, 40, 42, 44, 45) which increases the accessibility for water to flow in between the fixed hood portion and the side portions (32) during operation of the dishwater.

13 Claims, 2 Drawing Sheets

(56) References Cited

U.S. PATENT DOCUMENTS

| | | | | |
|---|---|---|---|---|
| 3,720,215 | A | 3/1973 | Haas | |
| 5,413,130 | A * | 5/1995 | Maruyama et al. | 134/95.3 |
| 7,803,430 | B2 | 9/2010 | Krumme | |

FOREIGN PATENT DOCUMENTS

| | | | | |
|---|---|---|---|---|
| EP | 0709055 | A1 | 5/1996 | |
| EP | 1229866 | A1 | 8/2002 | |
| EP | 2 184 000 | | 5/2010 | |
| GB | 301 268 | | 11/1928 | |
| GB | 943501 | * | 12/1963 | A47L 15/4257 |
| WO | WO-0134131 | A2 | 5/2001 | |
| WO | WO-2010/052021 | A1 | 5/2010 | |
| WO | WO 2010052021 | A1 * | 5/2010 | |
| WO | WO-2011/015313 | A1 | 2/2011 | |
| WO | WO-2012/016632 | A2 | 2/2012 | |
| WO | WO-2012/016710 | A2 | 2/2012 | |

OTHER PUBLICATIONS

International Search Report and Written Opinion for Application No. PCT/EP2011/003486, dated Jan. 16, 2013.

* cited by examiner

TABLE TOP DISHWASHER

CROSS REFERENCE TO RELATED APPLICATIONS

This application is a national stage application filed under 35 U.S.C. 371 of International Application No. PCT/EP2011/003486, filed Jul. 13, 2011, which claims priority from European Patent Application No. 10008216.3, filed Aug. 6, 2010, each of which is incorporated by reference herein in its entirety.

BACKGROUND OF THE INVENTION

The present invention relates to a tabletop dishwasher, i.e. to a compact dishwasher, which in contrast to common built-in devices, is designed to be placed on top of a kitchen worktop or which can be used as a portable device.

BRIEF SUMMARY OF THE INVENTION

It is the object of the present invention to provide a table top dishwasher which has a simple and lightweight construction and which yet provides for a reliable and comfortable operation.

In conformity with the present invention the above object is solved by a table top dishwasher as it is defined in claim 1. By providing the dishwasher with a top for accommodating articles to be cleaned and a cover member, which forms a hood over said tub, wherein the hood comprises a fixed hood portion and a door, the hood can be of lightweight design. That is, whereas in conventional dishwashers comprising a door that is tiltable about a horizontal axis and wherein the opened door constitutes a tray region for supporting a basket which accommodates the articles to be cleaned during loading and unloading of the dishwasher, in the table top dishwasher of the present invention the door only has to have sufficient structural strength so as to provide for a water-tight sealing during operation of the dishwasher, but does not need to have structural strength to support a dishwasher basket. Furthermore, with the door being designed to rotate within the fixed hood portion so that in the open position the door is positioned within the fixed hood portion, only little space is required for setting up the dishwasher.

In order to ensure that in the dishwasher suggested herein no soil particles accumulate between the side portions of the door and a respective wall region of the fixed hood portion, the side portions are provided with apertures through which during operation of the dishwasher water can flow into the space between the fixed hood portion and the side portions of the door so as to flush out any soil particles present therein. In this manner there is provided for an improved self-cleaning during operation of the dishwasher, wherein more water can reach the surfaces behind the door side portions. The water for flushing the space between the fixed hood portion and the side portions of the door either can be water that coincidentally is deflected from the tub walls, the basket or any of the goods accommodated therein, or can be fed intentionally to the apertures within the side portions of the door by spraying nozzles. Thus, water can be fed to the apertures by a nozzle provided at the sprayarm, such as a driving nozzle which is inclined to the vertical so as to cause a rotational movement of the sprayarm and which thus directs water towards the side walls of the tub. Preferred embodiments of the present invention are defined in the dependent claims.

Preferably, the side portions of the door at least in part extend in parallel to side regions of the fixed hood portion, so that as much space as possible remains available within the interior of the dishwasher, thus maximizing the volume within which articles to be cleaned can be placed.

The door can be an integral part comprising the central region and the lateral side portions so that no separate mounting steps are required to combine the center region and the lateral side portions. In a particularly preferred design, the door is a molded plastic part, which thus can be formed in a single molding step so as to further facilitate the manufacturing of the dishwasher.

Preferably, each of the side portions of the door comprises a plurality of apertures, wherein in particularly preferred embodiments at least two of these apertures are located at a different radial distance from the pivot point of the door and/or at different angular positions with respect to a line drawn through the aperture and the pivot point of the door, so as to facilitate water to reach the entire space between the side portions of the door and the fixed hood portion.

The side portions of the door can comprise reinforcing ribs on the side facing away from the fixed hood portion so as to further stabilize the door. Particularly if the door is a molded plastic part, the door thus can be provided with substantial structural strength also in embodiments wherein a relatively small thickness is selected for the door. While reinforcing ribs generally can be provided at any desired location at the door, reinforcing ribs particularly can be provided which surround the apertures.

In order to facilitate the flushing of soil particles from the space between the side portions of the door and the hood portion, the apertures preferably are beveled on the side facing towards the fixed hood portion.

A particularly lightweight construction can be achieved when the cover member has a generally half-cylindrical shape, and particularly a shape wherein the fixed hood portion comprises two substantially semi-circular side regions and an arcuate central region which stands about half of the generally half-cylindrical shape. Such a design allows for a particularly compact design, which nevertheless allows for a relatively large door opening and, due to the curvature of the surfaces, for sufficient structural strength. In the latter embodiments the central region of the door can comprise two substantially quarter-circular side portions and an arcuate central region, wherein the radius of curvature of the arcuate central region is slightly smaller than that of the arcuate central region of the fixed hood portion. In this manner, the door in the opened state requires very little space.

BRIEF DESCRIPTION OF THE SEVERAL VIEWS OF THE DRAWINGS

Preferred embodiments of the present invention will be described below by reference to the drawings, in which:

FIG. 1 shows a table top dishwasher comprising a tub 10 and a cover member 12, which forms a hood over tub 10. Hood 12 comprises a fixed hood portion 14 and a rotatable door 16. Door 16 is rotatably supported at substantially semi-circular side regions 18 of the fixed hood portion so as to be pivotable about a horizontal axis 20. Within tub 10 there is provided a basket 22, which may comprise a plurality of holders 24 for accommodating and fixing during a washing cycle a plurality of articles to be cleaned.

Figure 1:
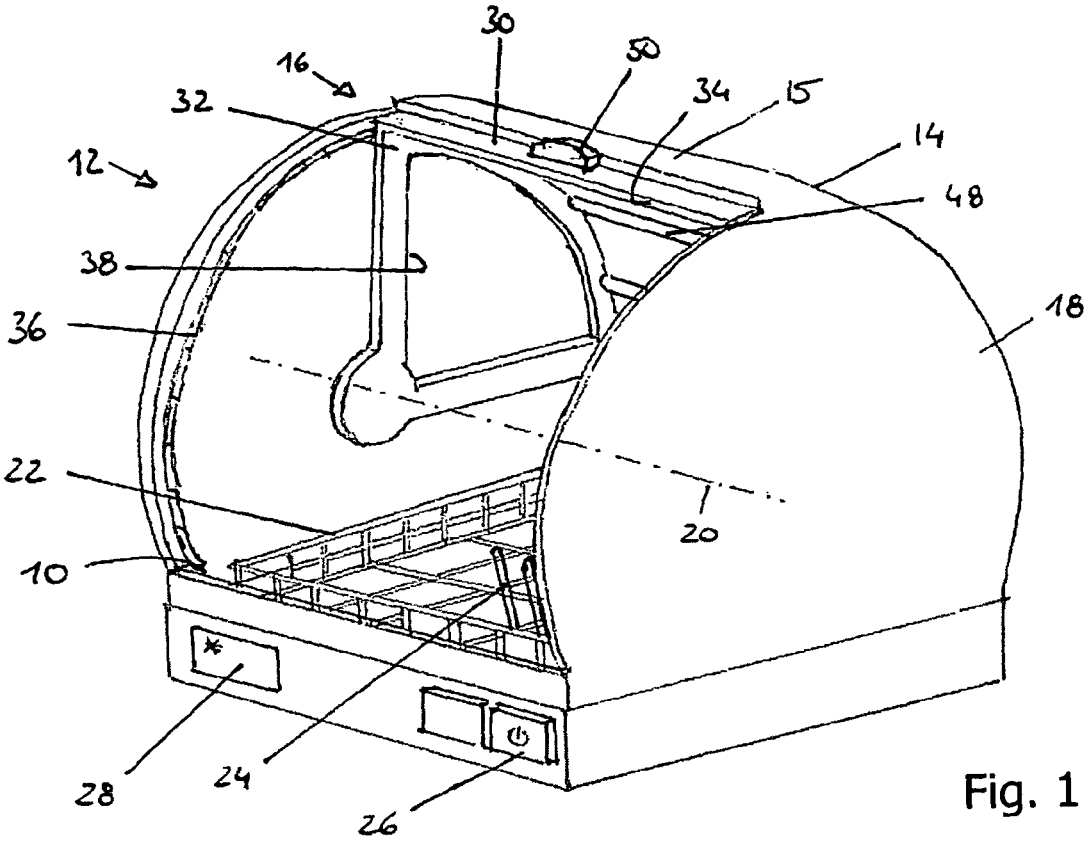
FIG. 1 is a perspective view of a table top dishwasher of the present invention.

Within tub 10 there further are provided means (not illustrated in the drawings) for circulating cleaning liquid throughout the interior of the dishwasher, such as a spray arm that is located below basket 22, and a circulation pump and optionally a separate drain pump. In the lower portion of the dishwasher which comprises tub 10 there further can be located any electrical components required for operation of the dishwasher, such as a power supply, a controller and the like, as well as operating switches 26 and a display 28.

In the embodiment shown in FIG. 1 cover member 12 is designed as a generally semi-cylindrical part, wherein approximately half of the arcuate surface shell is provided by the central region 15 of fixed hood portion 14 and the other half thereof is provided by central region 30 of door 16. Door 16 is rotatable about axis 20 between the open position shown in FIG. 1 and a closed position, wherein door 16 in FIG. 1 is rotated in a counter-clockwise direction until the lower edge 34 of door 16 contacts a respective sealing surface provided at tub 10. In order to prevent water from escaping from the interior of cover member 12 during operating of the dishwasher, a sealing member 36 is provided, which extends along the peripheral edge of side regions 18 of cover member 12 and which engages the side portions 32 of door 16 when the latter closed. While not shown in FIG. 1, in the closed position of the door also the upper edge of the door will contact a respective sealing surface which is provided proximal the upper edge of central region 15 of fixed hood portion 14.

In order to prevent soil particles from accumulating between the side portions 32 of door 16 and the side regions 18 of the fixed hood portion 14, the side portions 32 of door 16 are provided with apertures via which during operation of the dishwasher water can flow into the regions between side portions 32 and the fixed hood portion. In the embodiment shown in FIG. 1, the side portions 32 of the door are each provided with an aperture 38 which extends over a substantial portion of the side portions 32.

DETAILED DESCRIPTION OF THE INVENTION

In embodiments wherein the door 16 is a molded plastic part, providing for large apertures 38 may be considered to lower the rigidity of the door to an intolerable extent. In such embodiments, instead of providing for a single large aperture, a plurality of apertures can be provided, an example of which is shown in FIG. 2.

Figure 2:
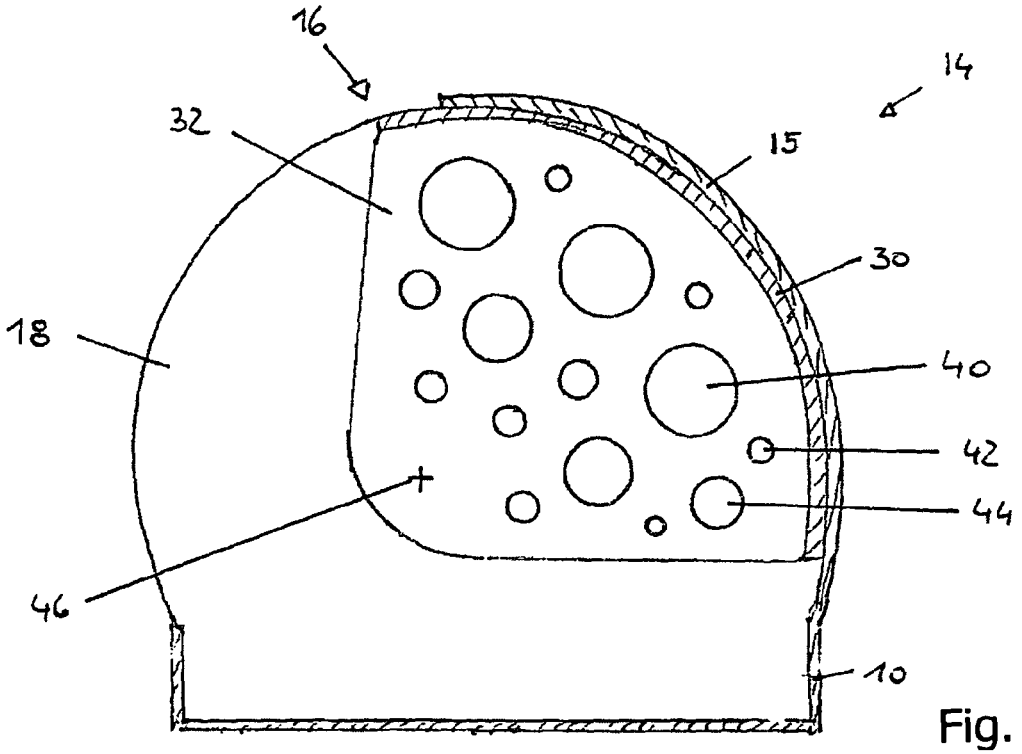
FIG. 2 is a sectional view of a modified embodiment of the dishwasher of FIG. 1.

In particular, FIG. 2 is a sectional view of a further embodiment of a table top dishwasher wherein side portion 32 of door 16 comprises a plurality of apertures 40, 42 and 44, which are located at different distances from the pivot point 46 of door 16 so as to facilitate water to reach the entire surface area between closed door 16 and the side region 18 of fixed hood portion 14. As shown in FIG. 2, apertures 40, 42 and 44 can be of different size and can be located in any desired position within the side portion 32 of door 16.

Figure 3:
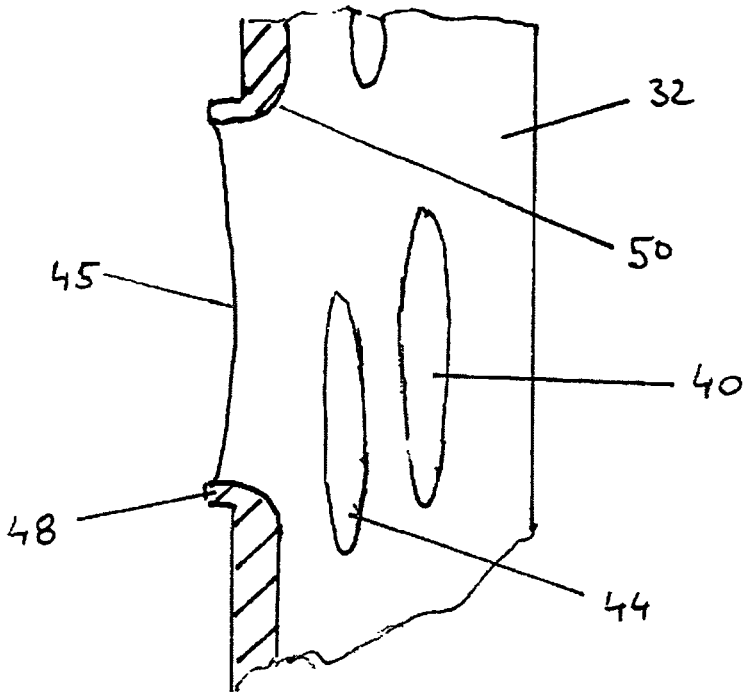
FIG. 3 is a perspective sectional view of a side region of the door of the dishwasher shown in FIG. 2.

Particularly if the door 16 is a molded plastic part, it is preferred to provide at least side portions 32 of door 16 with reinforcing ribs or reinforcing beads. In the embodiment shown in FIG. 3 a plurality of apertures 40, 44 and 46 is provided in side portion 32 of door 16, wherein a reinforcing rib or rim 48 is provided about each aperture on the side of side portion 32 which faces away from the respective side portion 18 of the fixed hood portion 14, so that the reinforcing ribs 48 project towards the washing chamber of the dishwasher. In order to facilitate soiled particles to be flushed out via the apertures, the apertures on the side of door side portions 32 facing the fixed hood portion 14 are provided with a beveling 50 so as to avoid any sharp edges where soiled particles could be trapped.

As is further shown in FIG. 1 also the central region 30 of rotatable door 16 can be provided with reinforcing ribs 48 so as to improve stability thereof. In the embodiment shown in FIG. 1 door 16 further comprises a handle 50 which facilitates closing of the door and which at the same time provides for a stop which delimits rotation of door 16 at the fully opened position shown in FIG. 1.

The invention claimed is:

1. A table top dishwasher, comprising:

(a) a tub for accommodating articles to be cleaned; and (b) a cover member forming a water-tight hood over said tub, said hood comprising a fixed hood portion and a door, the door comprising a central region and two lateral side portions rotatably connected to the fixed hood portion about a pivot axis, the door being rotatable between a closed position in which the central region forms part of the hood, and an opened position in which the door is positioned within the fixed hood portion, wherein said side portions each comprise at least one aperture spaced from the pivot axis, wherein each aperture is configured to enable water to flow in between the fixed hood portion and the side portions of the door during operation of the dishwater to prevent soil particles from accumulating between the fixed hood portion and the side portions of the door.

2. The dishwasher of claim 1, in which the side portions of the door at least in part extend in parallel to side regions of the fixed hood portion.

3. The dishwasher of claim 1, in which said door is an integral part comprising said central region and said lateral side portions.

4. The dishwasher of claim 3, in which said door is a molded plastic part.

5. The dishwasher of claim 1, in which each of said side portions comprises a plurality of apertures.

6. The dishwasher of claim 5, in which at least two of said apertures in said side portion are located at a different radial distance from the pivot point of the door.

7. The dishwasher of claim 5, in which at least two of said apertures in said side portion are located at different angular positions with respect to a line drawn through the aperture and the pivot point of the door.

8. The dishwasher of claim 1, in which said side portions of the door comprise reinforcing ribs on the side facing away from said fixed hood portion.

9. The dishwasher of claim 8, comprising reinforcing ribs which surround said apertures.

10. The dishwasher of claim 1, in which said apertures are beveled on the side facing towards said fixed hood portion.

11. The dishwasher of claim 1, in which said cover member has a half-cylindrical shape.

12. The dishwasher of claim 11, in which said fixed hood portion comprises two semi-circular side regions and an arcuate central region which spans about half of said half-cylindrical shape.

13. The dishwasher of claim 12, in which said central region of the door comprises two quarter-circular side portions and an arcuate central region, the radius of curvature of which is slightly smaller than that of the arcuate central region of the fixed hood portion.

* * * * *